United States Patent [19]

Kankaanpää et al.

[11] 4,059,482

[45] Nov. 22, 1977

[54] PAPER MACHINE PICKUP AND CREPE-SETTING PRESS SECTION

[75] Inventors: Matti Kankaanpää, Espoo, Finland; Ragnar Nylund, Taby, Sweden; Yrjö Reijonen, Jyvaskyla, Finland

[73] Assignee: Valmet Oy, Finland

[21] Appl. No.: 616,244

[22] Filed: Sept. 24, 1975

[30] Foreign Application Priority Data

Sept. 27, 1974 Finland ..... 742844

[51] Int. Cl.[2] ..... D21F 3/04

[52] U.S. Cl. ..... 162/281; 162/305; 162/360 R

[58] Field of Search ..... 162/281, 305, 306, 360 R, 162/111, 205

[56] References Cited

U.S. PATENT DOCUMENTS

| | | | |
|---|---|---|---|
| 1,514,556 | 11/1924 | Milkey | 162/281 |
| 2,653,523 | 9/1953 | Hornbostel | 162/360 R X |
| 3,072,522 | 1/1963 | Hornbostel | 162/281 X |
| 3,595,745 | 7/1971 | Cronin | 162/306 |
| 3,861,996 | 1/1975 | Dorfel | 162/360 R X |

FOREIGN PATENT DOCUMENTS

| | | |
|---|---|---|
| 2,211,023 | 7/1974 | France |

*Primary Examiner*—Richard V. Fisher
*Attorney, Agent, or Firm*—Steinberg & Blake

[57] ABSTRACT

A pickup and press section of a paper machine includes a suction pickup roll and felt which transfers a web from a wire, a first suction press roll and felt cooperating with the suction pickup roll and felt to define therewith a first press nip to which the web is transferred. A second suction press roll and a lower press roll situated therebeneath as well as a felt which cooperates with the latter lower press roll define a second press nip to which the web travels subsequent to the first press nip, the felt for the latter lower roll of the second press nip and for the first suction press roll being constituted by a single felt common to both of the latter rolls and supporting the web while it travels from the first to the second press nip. A felt cooperates with the second suction press roll and is situated directly next to a plain press roll which cooperates with the second suction press roll and felt thereof to define a third press nip, a suitable conveyer structure formed in part by the plain press roll serving to convey the web along a predetermined path beyond the third press nip. A creping doctor cooperates with the plain press roll to provide a creped web which travels along the predetermined path to a crepe-setting press nip formed between a pair of additional rolls.

8 Claims, 7 Drawing Figures

PAPER MACHINE PICKUP AND CREPE-SETTING PRESS SECTION

BACKGROUND OF THE INVENTION

The present invention relates to paper machines.

In particular, the present invention relates to the pickup and press section of a paper machine.

The present invention relates particularly to a press section wherein the paper web is conducted through successive press nips with so-called closed conduction according to which the web is continuously supported without any open draw, the web being supported at least through three successive press nips beyond the wire while engaging at all times either a felt or a roll, with dewatering of the paper web taking place as it travels through the pickup and press section.

As is well known, after a web undergoes an initial formation on the wire of a paper machine, this paper web has a considerable water content which may be approximately four times the fiber content of the web. However, at the stage when the web has travelled just beyond the couch roll and is about to be transferred from the wire by the pickup roll, the fiber structure of the web has not yet sufficiently solidified and the web does not yet have sufficient strength to resist strains to which the web will be subjected during subsequent operation thereon in the paper machine. The web is therefore conducted beyond the wire through the press section of the paper machine while passing through successive press nips defined between pairs of press rolls, and at each of these successive press nips the water content of the web is reduced while the strength thereof is increased. This type of mechanical drainage of water from the web influences in many ways both the operation of the paper machine and the properties of the finished paper. Those properties which are in particular influenced by the wet pressing are tensile strength, density, porosity, etc.

It is known that there is both a theoretical and a practical limit to the extent to which the web can be provided with a dry content as a result of the wet pressing. Beyond this limit dewatering must be carried out by evaporating procedures.

Of course, mechanical dewatering by pressing in the press section is, up to a certain point, considerably less expensive than evaporation of a corresponding amount of water in the drying section of the paper machine. It is highly desirable, therefore, to carry out as effective a dewatering as possible in the press section, so that as a result the paper web is subjected to a relatively intense pressing at the press nips in the press section.

However, because of the fact that the wet web detached from the wire is relatively weak, there are certain limits to the pressure which can be exerted on the web to extract water therefrom. If this pressure is too great the network of fibers which form the paper web will be deleteriously influenced. Furthermore, in order to prevent any detrimental effects which the mechanical pressing may have on the quality of the paper, a considerable amount of care must be utilized in selecting the combinations of rolls which are utilized in the press section of the paper machine in order to secure as effective a water removal as possible without danger of an undesirable decrease in the quality or strength of the finished paper.

It is conventional to utilize in the press section of a paper machine a press nip defined between a pair of press rolls one of which usually has a smooth surface while the other is a vented nip type of roll having a recessed surface, and a felt also travels through this type of nip. The paper web is conducted into a nip of this latter type in such a way that it travels between the felt and the surface of the plain roll. The felt functions to contribute to draining off water which is pressed out of the paper web as well as to reduce any tendency to form on the paper web a pattern or marking which will correspond to the recessed surface of the vented nip roll.

Moreover, it is conventional to provide only one felt at each press nip. The result of this latter type of arrangement is that dewatering from the web takes place in one direction only, namely toward the felt. Such dewatering in one direction only has the drawback of contributing toward an asymmetrical web structure because the fines and fillers in the paper web easily travel together with the draining water toward the felt and thus will accumulate at one surface only of the paper web. In order to avoid this latter undesirable lack of symmetry in the structure of the paper, at a press nip where a considerable amount of water is to be extracted from the web and where there is a particular risk that the paper web structure will be undesirably skewed or in other words will become undesirably asymmetric, it is possible to provide a pair of felts so that the paper web passes through the nip while engaging a pair of felts at the opposite surfaces of the paper web. With such a press nip it is advantageous that both of the press rolls be vented nip types of rolls having recessed surfaces, which of course means that such rolls may take the form of suction press rolls having perforated shells or they may be formed with bores having closed inner ends and extending inwardly from the exterior surface of the roll, or the rolls may be grooved, as is known in connection with vented nip rolls.

This type of pressing which takes place between two felts, in other words double-felted nip type of pressing, is of particular advantage with respect to the dewatering action. In some cases the extent of dewatering is facilitated in this way to such a great extent that the desired dry-matter content of the web can be achieved while utilizing smaller pressing forces than in a nip where only a single felt is provided. The result is that the web structure is strained to a lesser extent. On the other hand, in a double-felted nip, as contrasted with a single-felt nip, it is possible to increase the pressure between the rolls without running the risk of damaging the web. Double-felted press nips have already been proposed. In this connection reference may be made to the copending U.S. patent application Ser. No. 310,805, now abandoned. As is disclosed in the latter application a single double-felted press nip is provided while the subsequent nips are only single-felt types of nips. In the case where only the first of the series of press nips of the press section is double-felted, while the several subsequent nips are only single-felted, there is a possibility that the uniform, symmetrical distribution of the material in the web as achieved at the first double-felted nip will be disturbed and spoiled as a result of the bias which occurs at the following single-felt nips where dewatering takes place in one direction only. However, such subsequent single-felt nips as well as additional nips are required in order to be able to achieve a sufficient dryness of the web which has travelled through the press section.

In addition to the above problems in connection with achieving in the press section both a desirable degree of dryness in the web and a uniform structure throughout the thickness of the web, particular problems are encountered with certain types of paper particularly paper which is to have a highly porous structure, as well as paper and paper board of relatively thick grades, and also in connection with creped paper.

SUMMARY OF THE INVENTION

It is accordingly a primary object of the present invention to provide for a paper machine a pickup and press section capable of achieving in a gradual, cautious manner a paper web which travels from the press section to the drying section with a desirable low water content and with a web structure which does not have an undesirable lack of symmetry through the thickness of the web.

In addition, it is an object of the present invention to provide a pickup and press section particularly adapted to achieve a paper or board which is as highly porous as possible.

Also it is an object of the present invention to provide a pickup and press section capable of producing a creped paper.

Moreover, it is an object of the present invention to provide a pickup and press section which is, as compared to conventional pickup and press sections, relatively short and compact.

In particular it is an object of the present invention to provide many advantages with respect to the quality of the paper which is produced as well as with respect to the production process itself, by way of a pickup and press section wherein the web is conducted at least through three successive press nips subsequent to the wire without any open, unsupported draw, so that during this phase of the pressing operations the web is continuously supported while being conveyed in a so-called closed conduction manner.

Thus, according to the present invention the press section is particularly suitable in the production of relatively thick paper grades and boards wherein a high specific volume or bulk is an important property. Such a high bulk becomes possible because it is not necessary to utilize excessive pressing force in the press section of the invention.

According to the invention, the transfer of the web from the wire to the first press nip is carried out by means of a pickup roll and felt in such a way that this pickup roll at the same time cooperates with the first suction press roll to define therewith the first press nip. This construction is in contrast with the conventional manner in which the web is detached from the wire and transferred to the first press nip while adhering to the downwardly directed surface of the pickup felt. Such procedures cannot be successfully used in connection with production of a thick, heavy web. However, the press section of the present invention eliminates this latter drawback completely. This first press nip which is defined between the pickup roll and first suction press roll includes a pair of felts which respectively cooperate with the latter rolls so that the first press nip is a double-felted nip. The second nip is formed between a second suction press roll and a vented nip roll situated therebeneath, the latter roll having a recessed surface, and this second suction roll also operates with a felt while the recessed surface roll of the second nip has a felt cooperating therewith, so that the second nip also is double-felted. The latter recessed surface roll at the second nip and the first suction press roll in fact have a common felt which while travelling from the first suction press roll to the recessed surface roll of the second nip supports the web so as to avoid any open draw during travel of the web from the first to the second press nip. The third nip is formed by the second suction press roll and a plain press roll acting against the felt which cooperates with the second suction press roll. A suitable conveyer means formed in part by this latter plain press roll conveys the web beyond the third nip toward the drying section.

Thus, briefly stated, the present invention has in the press section at least two successive double-fitted press nips. With a press construction of this type an exceptionally symmetrical dewatering of the paper web is carried out and at the same time a high degree of dryness is achieved.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
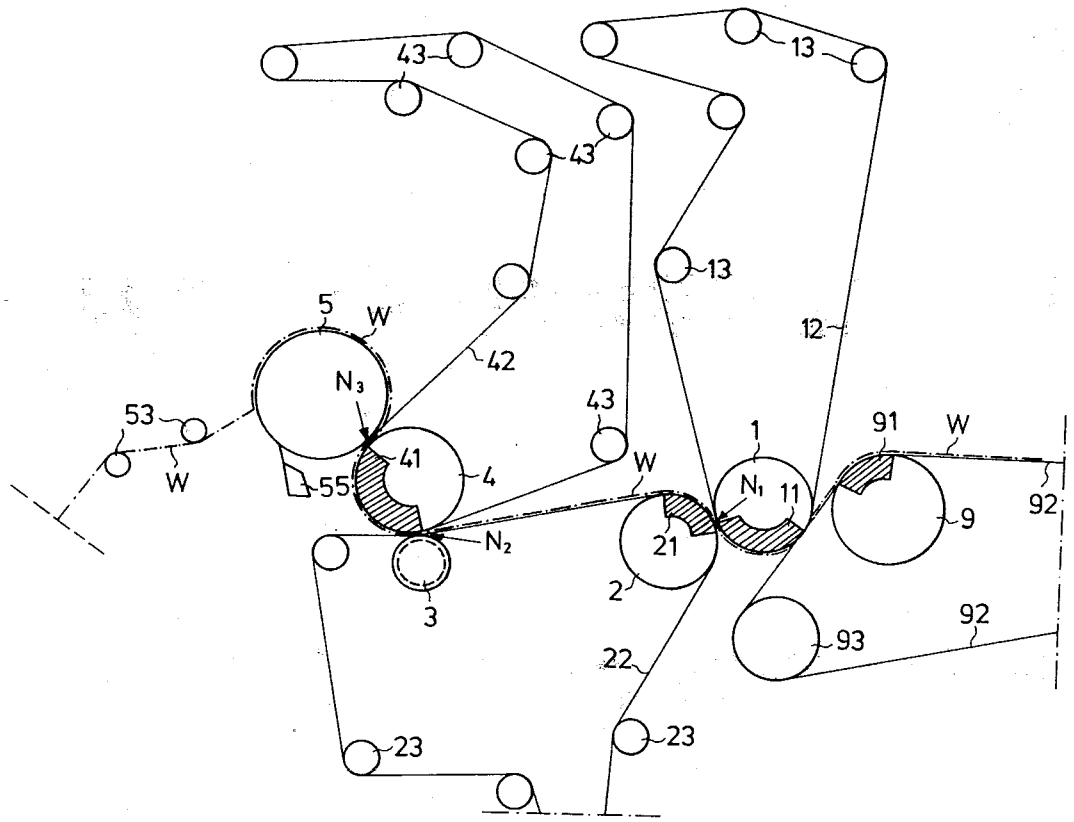
FIG. 1 is a schematic illustration of an embodiment of the invention having a five-roll press section provided with three press nips of which the first two are double-felted while the third is single-felted with the arrangement being such that the web is conducted through the nips beginning from the wire in a completely closed manner avoiding any open draw, i.e. the web is continuously supported by felt or roll surfaces.

In the pickup and press section which is schematically illustrated in FIG. 1 the web W which is formed on the wire 92 is detached and transferred from this wire by way of a pickup roll and felt means formed by the suction pickup roll 1 and the felt loop 12. The couch roll 9 is a suction roll having the suction sector 91, as is conventional, and the wire 92 travels from the couch roll 9 to the roll 93 which is a forward drive roll. It will be understood that the roll 9 rotates in a counterclockwise direction, as viewed in FIG. 1, so that the web W travels toward the left as viewed in FIG. 1.

Upon detachment of the web W from the wire 92 it adheres to the felt 12 as a result of the suction prevailing in the suction sector 11 of the suction pickup roll 1. According to one of the features of the present invention there is situated next to the suction pickup roll 1 a first suction press roll 2 having a suction press section 21 and the suction press roll 2 as well as the felt means 22 cooperate with the suction pickup roll 1 and felt means 12 to define the first press nip $N_1$. Thus, this first press nip $N_1$ is double-felted, including the felts 12 and 22, and it will be noted that the suction sector 11 extends from the wire 92 up to the suction sector 21 so that the web is continuously supported without any open draw while traveling from the wire through the first press nip $N_1$. In this first press nip $N_1$ dewatering takes place primarily in a symmetrical manner through both of the opposed surfaces or sides of the web simultaneously in opposed directions. The path of travel of the felt loop 12 is determined by the rolls 13 while the path of travel of the felt loop 22 is determined by the rolls 23. At the following press nip $N_2$ there is in the example of FIG. 1 a further felt loop 42 the path of travel of which is determined by the rolls 43. At the first press nip $N_1$ the web W becomes detached from the felt 12 and instead travels together with the felt 22 as a result of the action of the suction sector 21.

In this way the web W travels from the first press nip $N_1$ to the second press nip $N_2$ which is defined by the upper suction press roll 4 which cooperates with the upper felt means 42 and by the lower roll 3 which is a vented nip roll having a recessed surface which may be a suitably grooved surface, and it will be noted that the felt means of the lower roll 3 is formed by the same felt 22 which cooperates with the roll 2 at the first press nip so that the felt 22 is common to the rolls 2 and 3 and at its portion which travels from the roll 2 toward the roll 3 supports the web W as it travels from the first to the second press nip.

Figure 6:
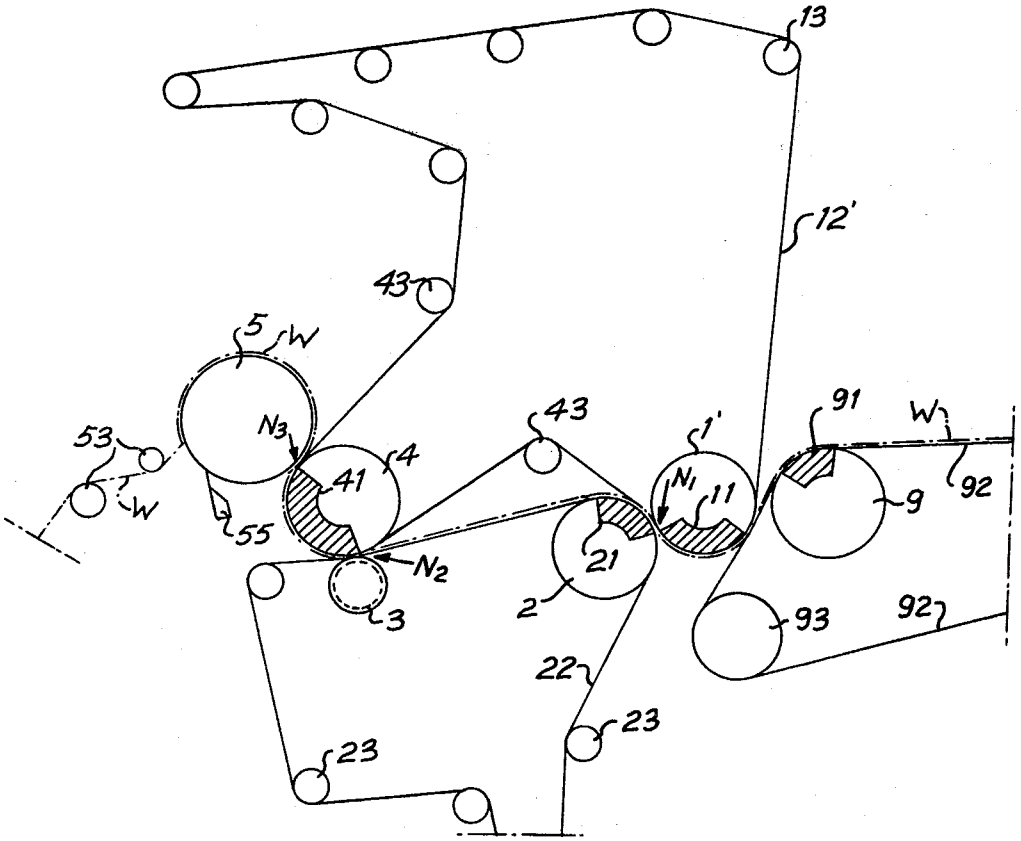
FIG. 6 shows an arrangement similar to FIG. 1 having only two felt loops.

It is to be noted, however, that instead of providing separate felt loops 12 and 42 it is possible, as shown in FIG. 6, to eliminate one of these felt loops and instead to have a single felt loop 12' which is also common to the first and second press nips, this single felt 12' traveling around the suction pickup roll 1 and the second suction press roll 4 while being guided by the rolls 13 and 43 in the manner indicated in FIG. 6. Otherwise the embodiment of FIG. 6 is the same as that of FIG. 1.

It is thus apparent that the second press nip $N_2$ is also double-felted and dewatering also takes place from the web W in an essentially symmetrical manner simultaneously in opposite directions through both of the opposed surfaces of the web. Because of the suction prevailing in the suction sector 41 of the suction press roll 4 the web W becomes detached from the felt 22 as the web travels through and beyond the second nip $N_2$, and now the web is carried along by the felt 42 up to the third press nip $N_3$. This third press nip is defined by a plain press roll 5 which is situated next to the second suction press roll 4 and the felt means 42 or 12' cooperating therewith. Thus, in this manner the web is transferred from the second press nip to the third press nip. A conveyor means formed in part by the plain press roll 5 is provided for conveying the web beyond the third press nip $N_3$ along a predetermined path, and part of this path is illustrated in FIG. 1 where the web W is shown guided by the rolls 53, a suitable doctor 55 being provided to keep the plain press roll 5 clean.

At this third press nip $N_3$ dewatering will take place only in one direction, namely toward the felt 42 or 12' and thus toward the second suction press roll 4. The web W is detached from the surface of the roll 5 in a manner which is well known and conducted by way of the guide rolls 53 toward the drying section of the paper machine, the drying section not being illustrated.

It will thus be seen that in the pickup and press section of the invention the web W is pressed during the first stage of dewatering at two successive double-felted press nips $N_1$ and $N_2$ with the web traveling through the latter press nips without any open, unsupported draw. This particular construction presents many advantages with respect to the quality of the paper which is produced as well as with respect to the production procedure itself. The result is a pressing operation which simultaneously is both effective and careful or cautious, achieving a finished paper which has as high a degree of porosity as possible.

With respect to the several suction sectors 11, 21, and 41 of the suction rolls 1, 2, and 4, it is to be understood that these sectors each may comprise one or more compartments with the suction pressure, lower than atmospheric pressure, prevailing either throughout the entire sector or only at certain selected parts of each sector as, for example, only at the immediate vicinity of the nips themselves.

Figure 2:
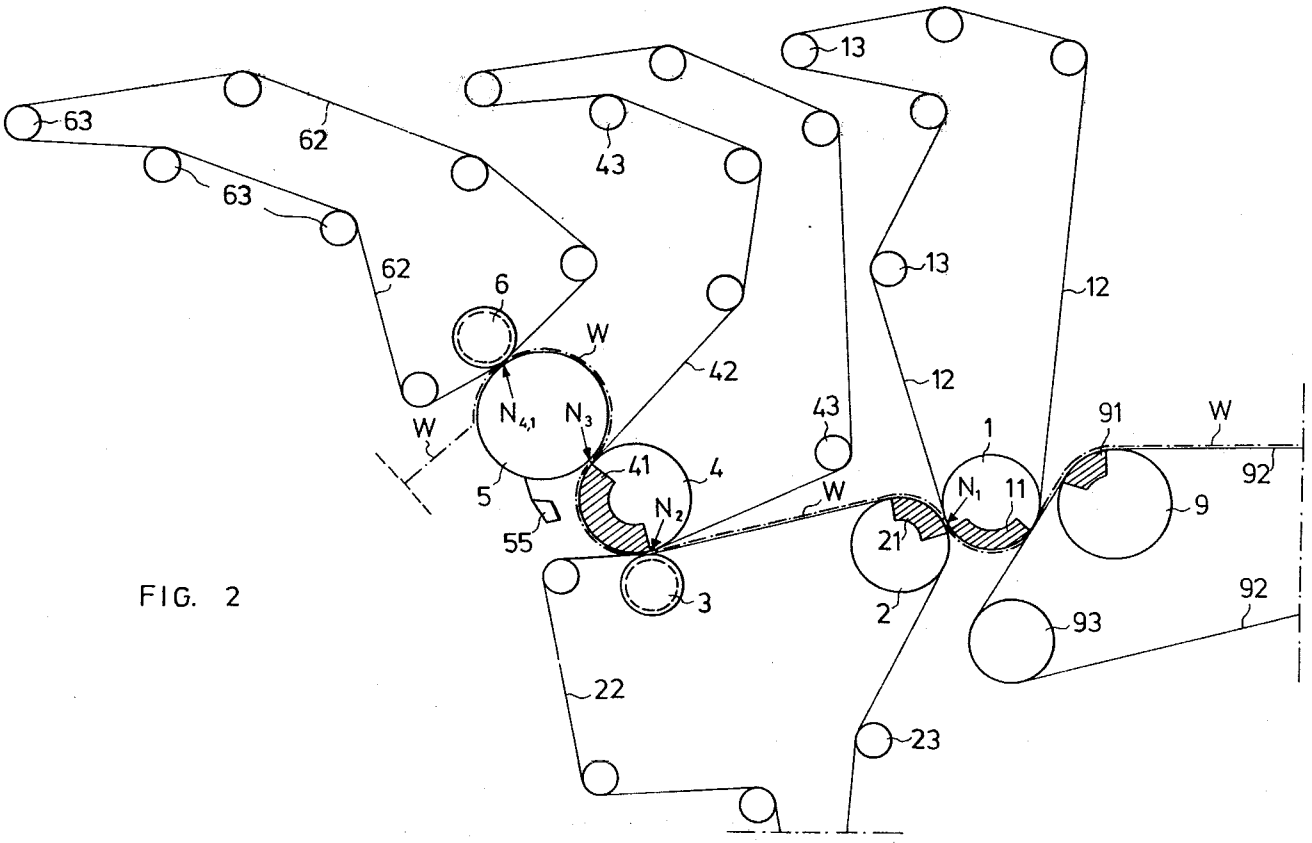
FIG. 2 illustrates a further embodiment of the invention according to which there is a six-roll press section which adds to the five-roll assembly of FIG. 1 a press roll with a recessed surface and a felt of its own, participating in the formation of a fourth nip.

Referring now to FIG. 2, it will be seen that according to this embodiment there is added to the structure of FIG. 1 a further roll 6 in the form of a vented nip roll having a recessed exterior surface which may, for example, be suitably grooved, and this roll 6 together with the felt loop 62, which is guided by the rolls 63 forms with the plain press roll 5 a further nip $N_{4,1}$. It will be noted that this press nip $N_{4,1}$ provides a dewatering action which takes place through that surface of the web which is directed toward the roll 6. Subsequent to the fourth press nip of FIG. 2 the web is detached from the roll surface in a common well known manner and further conducted to the drying section of the machine which is not illustrated.

Inasmuch as in the above-described embodiments of the invention the dewatering of the web is carried out symmetrically at the first two press nips $N_1$, $N_2$, a relatively high degree of dryness of the web is simultaneously achieved by the time the web has traveled through the second press nip, and thus the dewatering is only of a relatively slight quantity subsequent to the second press nip in the following third press nip of FIG. 1 and in the third and fourth press nips of FIG. 2 with the dewatering taking place in these latter press nips subsequent to the second press nip in only one direction. However, this latter factor will not have any appreciable effect on the distribution of the material which forms the web.

Figure 3:
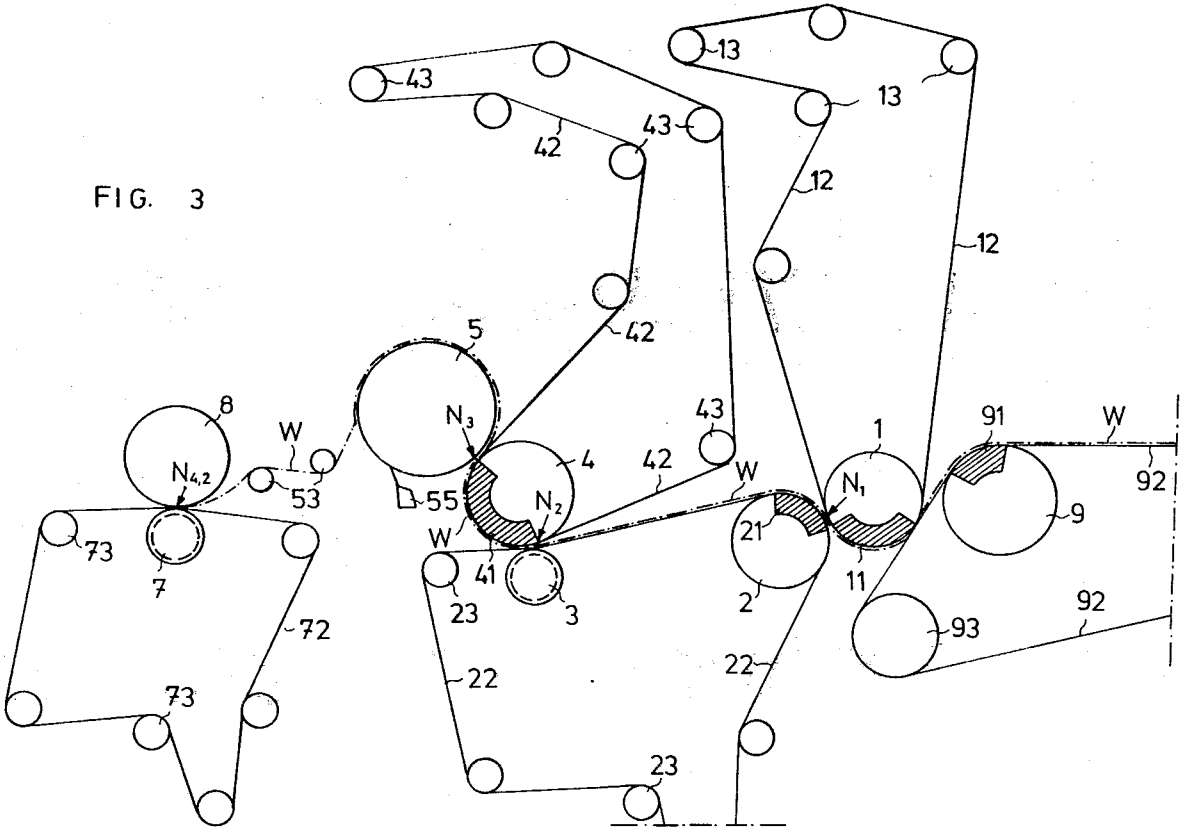
FIG. 3 illustrates an embodiment of the invention having a five-roll, three-nip press section followed by a separate pair of rolls including a lower roll with a recessed surface having its own felt loop and an upper plane roll cooperating with the lower roll and the felt thereof to form a fourth nip.

However, if in fact it is desirable to attempt to achieve a web structure which is as symmetrical as possible, then an arrangement as shown in FIG. 3 may be utilized. The embodiment of FIG. 3 completes that of FIG. 1 with a pair of additional press rolls 7 and 8 of which the lower roll 7 has a recessed surface which may be grooved, for example, and this lower roll 7 cooperates with its own felt loop 72, the path of travel of the felt 72 being determined by rolls 73. This fourth press nip of FIG. 3 is formed by the lower press roll 7 and felt means 72 which cooperate with the upper press roll 8 which may be a plain roll. In this way the embodiment of FIG. 3 provides a fourth press nip $N_{4,2}$ wherein the dewatering will take place downwardly toward the felt 72 and the roll 7. It will be noted that this particular direction is opposite to the dewatering direction at the third nip $N_3$ defined between the rolls 4 and 5. Thus, with the embodiment of FIG. 3 the arrangement is such that after the first two double-felted press nips there are a pair of single-felt press nips wherein dewatering takes place first in one direction and then in the opposite direction and it will be noted that at these last two press nips the web is situated first at one side against the smooth-surfaced roll 5 and then at its opposite side against the smooth-surfaced roll 8.

Figure 4:
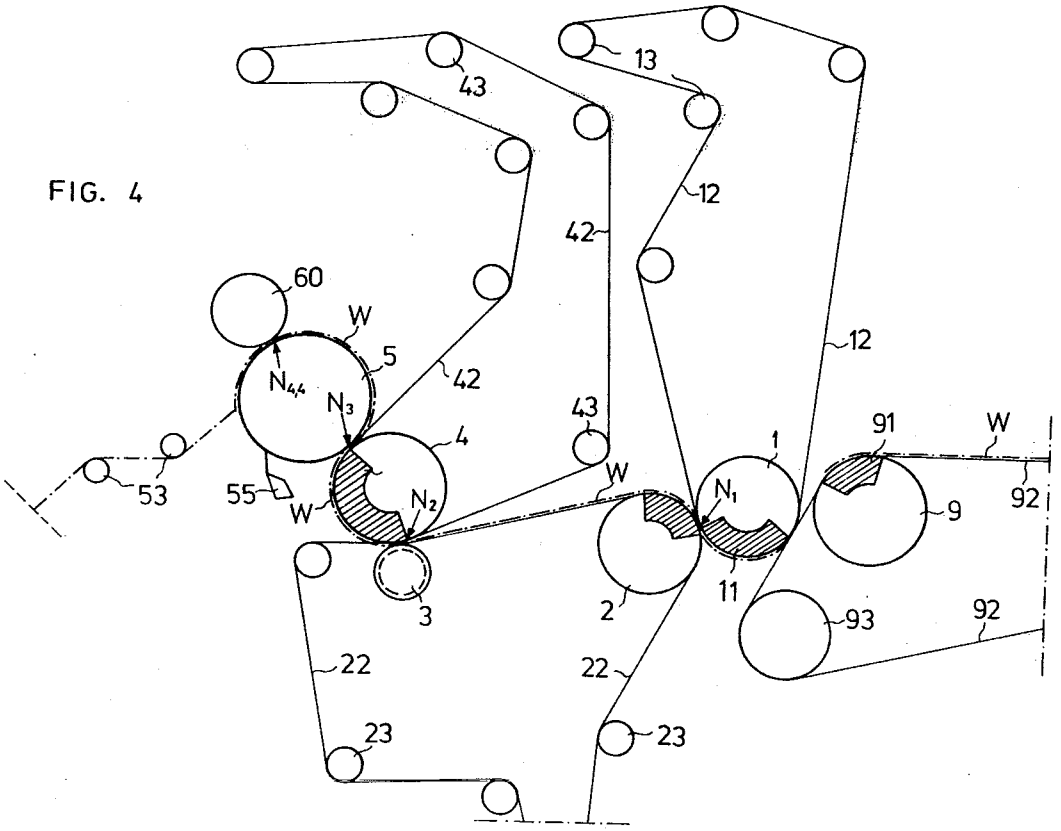
FIG. 4 illustrates a six-roll press section which adds to the arrangement of FIG. 1 an additional plane press roll which without any felt cooperates with the plane press roll of FIG. 1 to define a fourth nip intended to bring about a so-called smoothing effect without dewatering.

According to FIG. 4, the embodiment of FIG. 1 is completed with an additional smooth-surfaced plain press roll 60 which may, for example, have a soft rubber covering. This roll 60 cooperates with the plain press roll 5, without any felt between these rolls 5 and 60 which form the fourth press nip $N_{4,4}$ of the embodiment of FIG. 4. Thus, at this fourth pess nip of FIG. 4 a smoothing and equalizing effect on the paper web surface will be provided at the surface of the web opposite from the surface engaged by the plain press roll 5 at the third press nip $N_3$.

Figure 5:
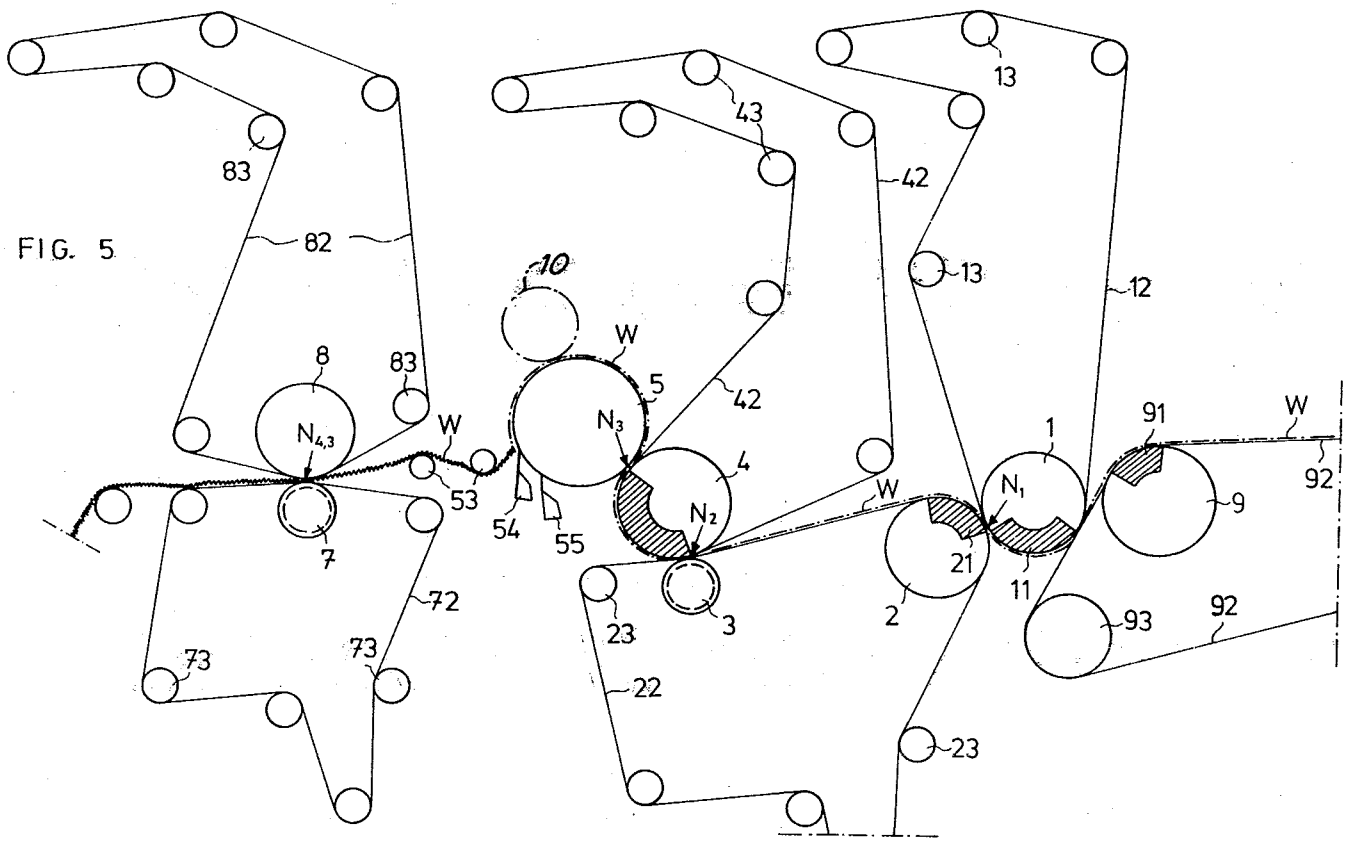
FIG. 5 illustrates an arrangement where the five-roll press section of FIG. 1 having three dewatering press nips is followed by an additional pair of rolls each having its own felt and defining a further press nip while by way of an optional additional roll shown in phantom lines in FIG. 5 it is possible to provide still another press nip so that a total of five press nips may be provided with an arrangement as shown in FIG. 5.

Referring to FIG. 5, it will be seen that this embodiment is similar to that of FIG. 3 in that the conveyor means which conveys the web beyond the third press nip and which is formed in part by the plain press roll 5 includes not only an additional pair of press rolls 7 and 8 with a lower felt loop 72 as described above in connection with FIG. 3, but also a further felt 82 guided by the rolls 83 and cooperating with the plain upper press roll 8 of FIG. 5 so that in this case a double-felted fourth press nip $N_{4,3}$ is formed along the path of travel provided for the web W by the conveyor means as the web travels beyond the third press nip $N_3$. Thus, the embodiments of FIG. 2–5 respectively provide for the web the fourth press nip $N_{4,1}$, of FIG. 2, the fourth press nip $N_{4,2}$ of FIG. 3, the fourth press nip $N_{4,4}$ of FIG. 4, and the fourth press nip $N_{4,3}$ of FIG. 5. However, it is only in the case of FIG. 5 that this fourth press nip is double-felted whereas in FIGS. 2 and 3 the fourth press nip is single felted and in FIG. 4 there is no felt at the fourth press nip.

The press section illustrated in FIG. 5 is particularly well suited for producing wet-press creped paper grades. The separate pair of additional rolls 7 and 8 are intended to press the web which is creped in the press section according to a wet-creping procedure by means of a creping doctor blade 54. Thus, this particular type of procedure is particularly suitable for providing grades of paper which, for example, may form a light crepe paper utilized as an intermediate inner layer for sheet material used in paper sacks, for example. A so-called crepe setting procedure by a pressing operation is required in the production of such paper grades.

Thus it will be seen that according to FIG. 5 the web W is detached from the exterior surface of the plain press roll 5 prior to crepe-setting by way of the creping doctor blade means 54.

In connection with FIG. 5 it is to be noted that a further press nip may be provided subsequent to the third press nip $N_3$ but prior to the press nip $N_{4,3}$ by way of an additional roll means 10, shown in phantom lines in FIG. 5 cooperating with the plain press roll 5 to provide a still further press nip. Thus, the roll 60 of FIG. 4 may be utilized for the roll 10 of FIG. 5, or it is also possible to utilize the roll 6 and felt 62 of FIG. 2 for the purpose of producing the additional nip at the location of the roll 10 in FIG. 5. Thus, with such an arrangement the fourth nip will be formed either by the fourth nip $N_{4,1}$ of FIG. 2 or the fourth nip $N_{4,4}$ of FIG. 4, while the fifth nip will be formed by the nip $N_{4,3}$ shown in FIG. 5. It is to be noted that such an optional additional roll 10 as shown in FIG. 5, capable of being constituted by either the roll 60 of FIG. 4 or the roll 6 and felt 62 of FIG. 2, can also be utilized with the embodiment of FIG. 3 in which case the nip $N_{4,2}$ of FIG. 3 will become the fifth press nip while the fourth press nip will be provided as described above in connection with FIG. 5 at the plain press roll 5 subsequent to the third press nip $N_3$ in a manner corresponding to the press nip $N_{4,1}$ of FIG. 2 or the press nip $N_{4,4}$ of FIG. 4.

Figure 7:
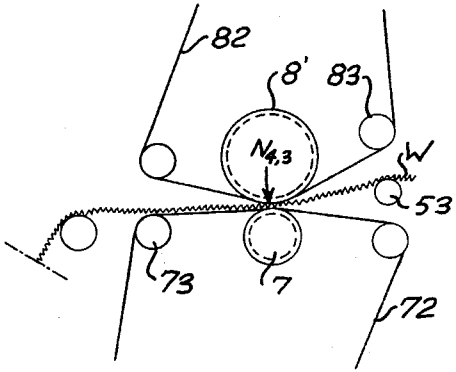
FIG. 7 shows a variation of the final press nip structure of FIG. 5 according to which the upper additional roll is a roll with a recessed surface, FIG. 7 showing only that part of FIG. 5 which has been modified in connection with the final upper press roll.

Assuming that the optional roll 10 is not utilized in FIG. 5, then it will be seen that this embodiment provides three double-felted nips $N_1$, $N_2$ and $N_{4,3}$, and this arrangement is particularly advantageous from the standpoint of achieving as high a bulk as possible in the paper or board which is manufactured. Moreover, instead of utilizing a plane press roll 8 in FIG. 5, it is possible to use instead a vented nip roll having, for example, a grooved surface, and it will be noted that this variation is illustrated in FIG. 7 where the roll 8' which replaces the roll 8 of FIG. 5 is shown as having a recessed exterior surface formed, for example, by grooves. Otherwise the embodiment of FIG. 7 is identical with that of FIG. 5.

With an arrangement as shown in FIG. 5, the type of roll 8 and the covering material thereof will be determined in accordance with the requirements of the paper which is to be produced. It will be noted that the crepe-setting procedure takes place at the nip $N_{4,3}$ between rolls 7 and 8 of FIG. 5, and in connection with such a crepe-setting procedure it is advantageous to provide the roll 8 with a soft covering material such as a suitable soft rubber.

What is claimed is:

1. In a pickup and press section of a paper machine, suction pickup roll and felt means for transferring a web away from a wire while supporting the web during transfer thereof, first suction press roll and felt means situated next to said suction pickup roll and felt means and defining therewith a first press nip to which the web is transferred by said suction pickup roll and felt means while being continuously supported thereby, second suction press roll and felt means and a lower roll and felt means situated next to said second suction press roll and felt means for defining therewith a second press nip, said lower roll of said lower roll and felt means at said second press nip having a recessed exterior surface and said felt means of said lower roll and felt means at said second press nip and said first suction press roll and felt means at said press nip being formed by a felt common to said first suction press roll and said lower roll at said second press nip, and said common felt supporting the web as it travels beyond said first press nip to said second press nip, first plain press roll means situated next to said second suction press roll and felt means and defining therewith a third press nip, said second suction press roll and felt means transferring the web beyond said second press nip to said third press nip while continuously supporting the web, whereby the web after being picked up by said suction pickup roll and felt means travels with closed conduction through at least three press nips the first two of which are double-felted while the third is single-felted, thus avoiding open draw of the web at least up to said third press nip, and conveyor means formed in part by said first plain press roll means for conveying the web beyond said third press nip along a predetermined path away from said third press nip, said conveyor means including a pair of additional rolls situated along said predetermined path beyond said first plain roll means of said third press nip and a felt cooperating with one of said additional rolls and defining with the other of said additional rolls a crepe-setting press nip to which the web travels along said predetermined path when conveyed beyond said first plain press roll means of said third press nip, said conveyor means including a second plain roll means situated next to said first plain roll means of said third press nip and defining with said first plain roll means a fourth press nip to which the web is conveyed by said first plain roll means while travelling beyond said third nip and while continuously supported by said first plain roll means, so that the web first travels through and beyond said fourth press nip before travelling along said predetermined path to said pair of additional rolls, and creping doctor means cooperating with said first plain press roll means subsequent to said fourth press nip for providing a creped web travelling along said predetermined path to said crepe-setting press nip where crepe-setting is performed by said pair of additional rolls and said felt cooperating with one of said additional rolls.

2. The combination of claim 1 and wherein said felt means of said suction pickup roll and felt means and said felt means of said second suction press roll and felt means are constituted by separate felts.

3. The combination of claim 1 and wherein said second plain roll means has a soft covering and cooperates with said first plain roll means to define said fourth press nip without any felt between said first and second plain roll means.

4. The combination of claim 1 and wherein said additional rolls include upper and lower rolls, said lower roll having a recessed exterior surface and said felt cooperating with said lower roll while said upper roll of said pair of additional rolls is a plain roll.

5. The combination of claim 4 and wherein a further felt cooperates with said upper additional roll to provide with said felt which cooperates with said lower additional roll a double-felted nip at said crepe-setting press nip.

6. The combination of claim 5 and wherein said upper additional roll also has a recessed exterior surface.

7. The combination of claim 4 and wherein said upper additional roll is a plain roll having a soft covering.

8. The combination of claim 1 and wherein said suction pickup roll and felt means and said second suction press roll and felt means both cooperate by way of the felt portions thereof with said common felt for exposing a web on said common felt at an upper surface of said web as it travels with and is supported by said common felt from said first to said second press nip.

* * * * *